US005357891A

United States Patent [19]

Kobayashi et al.

[11] Patent Number: 5,357,891

[45] Date of Patent: Oct. 25, 1994

[54] TOWED WATERCRAFT

[75] Inventors: Noboru Kobayashi; Mitsuhisa Hirano, both of Iwata, Japan

[73] Assignee: Yamaha Hatsudoki Kabushiki Kaisha, Iwata, Japan

[21] Appl. No.: 12,313

[22] Filed: Feb. 2, 1993

[51] Int. Cl.[5] ..... B63B 21/56

[52] U.S. Cl. ..... 114/242; 114/270

[58] Field of Search ..... 114/242, 248, 249, 250, 114/251, 343, 352; 441/72, 64

[56] References Cited

U.S. PATENT DOCUMENTS 5,119,752 6/1992 Doherty ..... 114/270

FOREIGN PATENT DOCUMENTS 63-43888 2/1988 Japan .
63-43889 2/1988 Japan .
63-43893 2/1988 Japan .
28088 1/1990 Japan ..... 114/352
143799 6/1991 Japan ..... 441/72

*Primary Examiner*—Jesus D. Sotelo
*Attorney, Agent, or Firm*—Knobbe, Martens, Olson & Bear

[57] ABSTRACT

A number of embodiments of towing and towed watercrafts with particular emphasis on the construction and operation of the towed watercraft. The towed watercraft is formed with a hull that is configured to accommodate the water flow from a jet propulsion unit driving the towing watercraft so as to reduce resistance and improve the flow resistance of the towed watercraft. The towed watercraft has its seat disposed below the seat of the towing watercraft so an operator on the towing watercraft will not have his rearward vision impaired. A wide variety of traction devices are disclosed, each having a rigid tow bar and an arrangement for precluding pivotal movement of the towed watercraft relative to the towing watercraft upon deceleration of the towing watercraft. Arrangements are also disclosed wherein an outboard motor may be positioned in a container of the towed watercraft for auxiliary power of the towed watercraft.

77 Claims, 9 Drawing Sheets

TOWED WATERCRAFT

BACKGROUND OF THE INVENTION

This invention relates to a towed watercraft and more particularly to an improved type of watercraft that may be towed by a small jet propelled watercraft.

Recently there has been an interest in a type of watercraft called a "Personal Watercraft." This type of watercraft is relatively small and is designed to be operated primarily by a single rider, although in some instances accommodations are made for carrying one or more passengers. The rider normally operates the water vehicle seated in a straddle fashion and any passengers which are accommodated normally sit in tandem fashion behind the rider. This type of watercraft is generally powered by a jet propulsion unit which may be mounted in a tunnel position beneath the rider's seat. Although this type of watercraft has a number of advantages and desirable points, it should be readily apparent that the number of passengers or load carrying capacity of this type of watercraft is relatively limited.

One way in which more passengers can be accommodated is if the small watercraft tows an additional, normally unpowered watercraft. The towed watercraft can provide additional seating accommodation. Although this has an advantage, there are some disadvantages with towed watercraft.

For example, since it is desirable to accommodate additional passengers, the towed watercraft generally will have a width that is substantially greater than that of the towing watercraft or, alternatively, it will nevertheless present a hull area that is disposed to the rear of the discharge nozzle of the jet propulsion unit. This means that the towed watercraft hull interferes with the discharge of water from the powering watercraft's jet propulsion unit and a reduction in the propulsion efficiency occurs.

It is, therefore, a principal object of this invention to provide an improved hull configuration for a towed watercraft.

It is a further object of this invention to provide a hull configuration for a towed watercraft which will accommodate substantial weight and which will nevertheless avoid interference with the discharge from the jet propulsion unit of the towing watercraft.

Another disadvantage in the use of towed watercrafts is that the towed watercraft can interfere with the visibility of the operator of the towing watercraft. That is, the towed watercraft can significantly impair the rearward vision of the rider of the towing watercraft, an obvious disadvantage.

It is, therefore, a still further object of this invention to provide an arrangement for a towed watercraft wherein the towed watercraft will not interfere with the vision from the towing watercraft.

When one watercraft tows another one, some device must be provided between the towing watercraft and the towed watercraft so as to permit the towed watercraft to be towed. If a rope or flexible device is utilized for this purpose, there are a number of disadvantages. First, the range of movement of the towed watercraft can be difficult to control and this can provide a number of disadvantages. For example, the towed watercraft may stray from one side to the other from the towing watercraft. Also, when the towing watercraft is decelerated, the towed watercraft can strike the towing watercraft.

It is, therefore, a further object of this invention to provide an improved towing arrangement for towing a towed watercraft from a towing watercraft.

In accordance with the object stated above, many of the disadvantages of the prior art types of constructions employing tow ropes can be avoided through the use of a rigid traction means between the watercrafts. However, such arrangements have a number of other disadvantages. For example, it is desirable to ensure that the downward load exerted on the towing watercraft by a rigid traction bar will not be excessive.

It is, therefore, a still further object of this invention to provide an improved arrangement for controlling the amount of downward force asserted on a towing watercraft from a rigid traction device for towing a towed watercraft.

The use of a rigid traction bar, although avoiding some of the problems of control of the position of the towed watercraft relative to the towing watercraft itself, however, has some disadvantages. For example, it is desirable to permit some movement of the towed watercraft relative to the towing watercraft and this can be done by employing some form of pivotal joint in the traction bar. However, there still arises the problem of control of the position of the towed watercraft relative to the towing watercraft, particularly upon deceleration.

It is, therefore, a still further object of this invention to provide an improved control arrangement for the towed watercraft of a towing/towed watercraft combination including rigid traction devices.

As has been noted, the use of towed watercrafts has the advantage of providing additional passenger capability without requiring an additional propulsion unit for the added watercraft. However, if the towed watercraft has no provision for self propulsion, this can give rise to certain problems.

It is, therefore, a still further object of this invention to provide an improved arrangement whereby a towed watercraft may be provided with an optional, emergency power supply.

SUMMARY OF THE INVENTION

A first feature of the invention is adapted to be embodied in a towed watercraft that is adapted to be towed by a jet propelled watercraft having a discharge nozzle positioned toward its stern and discharging water generally rearwardly for propulsion thrust. The towed watercraft is comprised of a hull portion adapted to be submerged in part in a body of water and a rider's area carried at the upper end of the hull portion for carrying at least one rider. The rider's area and the forward part of the hull portion define a generally open area through which water discharged from the discharge nozzle of the towing jet propelled watercraft may pass without diminution of the thrust force.

Another feature of the invention is adapted to be embodied in a combination of a towing and towed watercraft which includes a towing watercraft that comprises a hull, a propulsion device carried by the hull for propelling the towing watercraft and a rider's area for accommodating at least an operator for the towing watercraft. The towed watercraft is comprised of a hull defining a passenger's area adapted to accommodate at least one passenger in a seated fashion. Towing means are provided for attaching the towed watercraft to the towing watercraft for its towing. The rider's area of the towing watercraft is positioned so that an operator's head will be positioned above the head of a passenger seated on the towed watercraft to afford relatively unobstructed rearward visibility for the rider.

Another feature of the invention is adapted to be embodied also in a combination of a towing and towed watercraft wherein the towing watercraft is comprised of a hull, a propulsion device carried by the hull for propelling the towed watercraft and a rider's area for accommodating at least an operator on the towing watercraft. The towed watercraft is comprised of a hull defining a passenger's area adapted to accommodate at least a passenger and towing means are provided for attaching the towed watercraft to the towing watercraft for its towing. In accordance with this feature of the invention, the towing means comprises a rigid tow bar affixed at its forward end to the towing watercraft and its rearward end to the towed watercraft.

In accordance with the construction of the invention as described in the preceding paragraph, additional features of this concept include an arrangement for providing the center of gravity of the loads in the towed watercraft so as to control the amount of downward force exerted on the rear of the towing watercraft, the use of a pair of tow bars to control movement of the towed watercraft when the towing watercraft is decelerated and a single tow bar arrangement that incorporates devices for reducing the movement of the towed watercraft relative to the towing watercraft and controlling this movement upon deceleration of the towing watercraft.

Another feature of the invention is adapted to be embodied in a towed watercraft for primary water operation by towing by a towing watercraft. The towed watercraft is comprised of a hull defining a rider's area for accommodating at least one passenger and the hull is devoid of a propulsion device but is formed with means for accommodating an outboard motor for propulsion thereby.

In accordance with the feature of the invention described in the preceding paragraph, arrangements are provided for accommodating either front or rear mounting of the outboard motor and a variety of tow arrangements are also possible.

DETAILED DESCRIPTION OF THE PREFERRED EMBODIMENTS OF THE INVENTION

Figure 1:
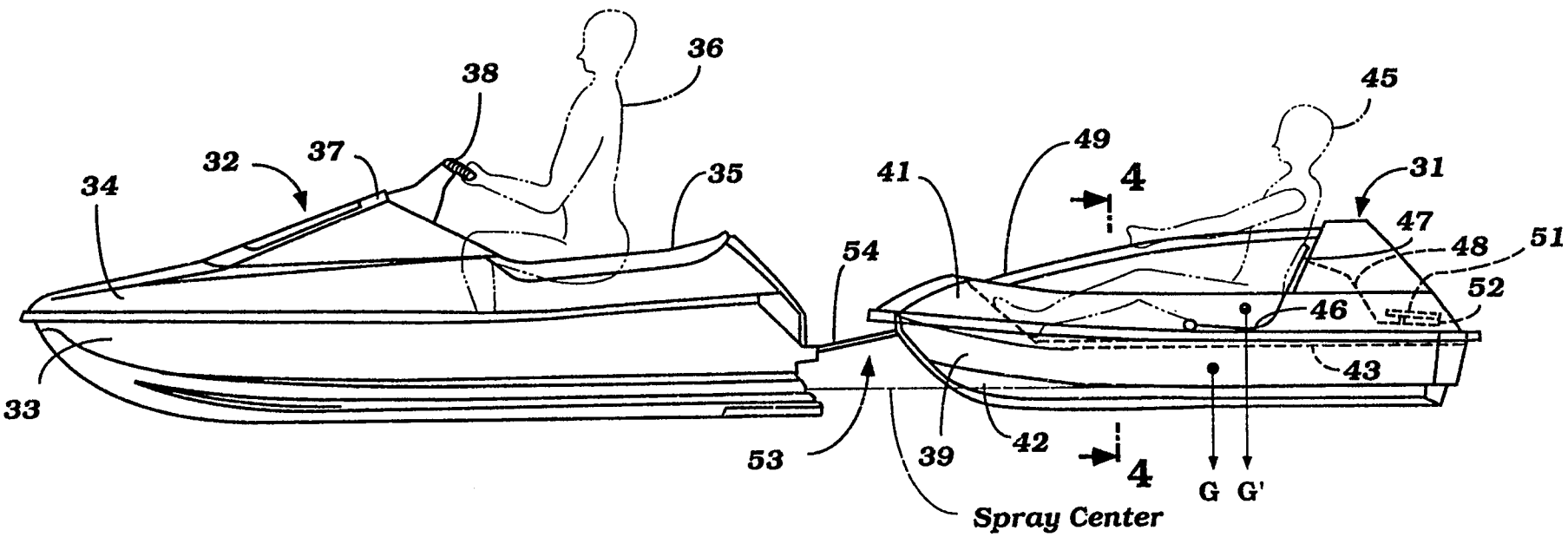
FIG. 1 is a side elevational view of a combination towing and towed watercraft constructed in accordance with a first embodiment of the invention.
Figure 2:
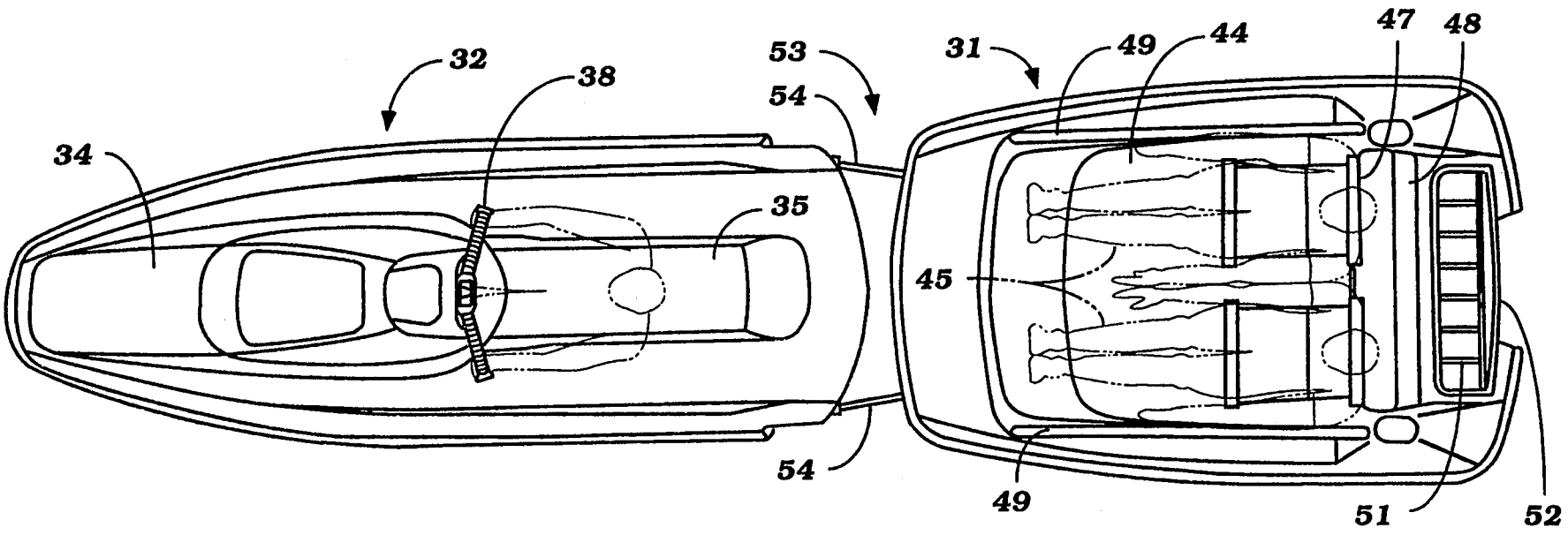
FIG. 2 is a top plan view of this embodiment.
Figure 3:
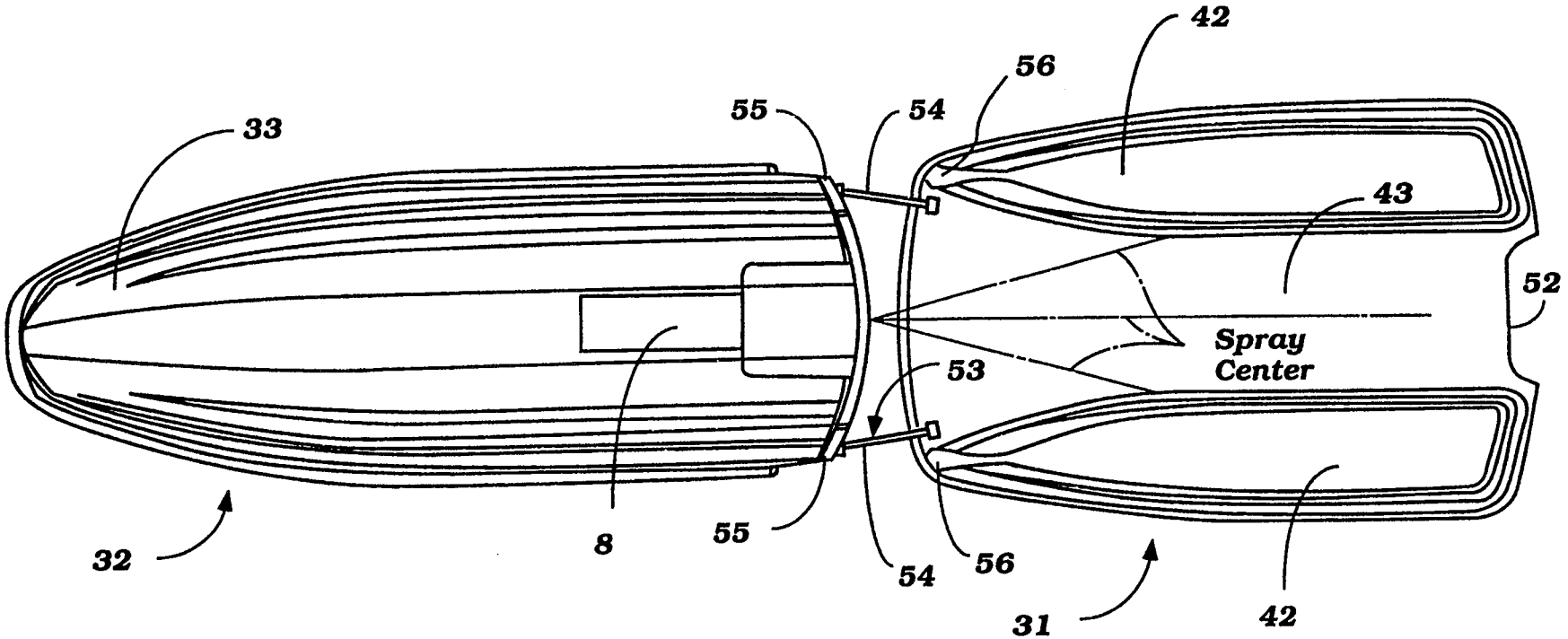
FIG. 3 is a bottom plan view of this embodiment.
Figure 4:
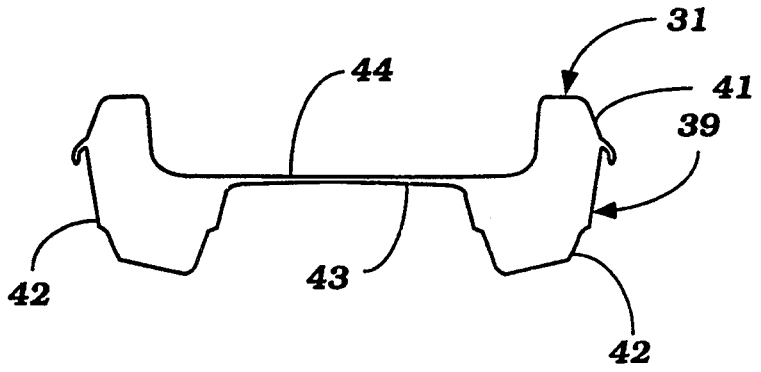
FIG. 4 is a cross-sectional view showing the hull configuration of the towed watercraft taken along the line 4—4 of FIG. 1.

Referring first to the embodiment of FIGS. 1–8 and specifically initially to FIGS. 1–3, a towed watercraft constructed in accordance with this embodiment of the invention is identified generally by the reference numeral 31. The towed watercraft 31, as will become apparent, is generally devoid of any propulsion device and the towed watercraft 31 is adapted to be towed by a conventional type of watercraft, indicated generally by the reference numeral 32 and described generally as a towing watercraft.

The towing watercraft 32 is the type of watercraft known as a personal watercraft and is comprised of a hull that is made up of a lower hull portion 33 and an upper deck portion 34 with the hull assembly being made generally from molded fiberglass reinforced resinous materials of a known type. The hull defines a rider's area in which a rider's seat 35 is mounted and which is adapted to accommodate a single rider, shown in phantom and identified by the reference numeral 36. This rider 36 is seated on the seat 35 in straddle fashion. As should be readily apparent, one or more passengers may be accommodated on the seat 35 behind the rider 36 in tandem fashion.

The watercraft 32 is powered by an internal combustion engine which is generally mounted under a hatch cover 37 which is pivotally connected to the deck 34 and forwardly of the seat 35. This internal combustion engine drives a jet propulsion unit which is not illustrated in these figures but which is positioned in a tunnel beneath the seat 35 and which has a downwardly facing water inlet opening, an impeller section that contains an impeller driven by the engine for drawing water through the water inlet section and a discharge nozzle through which the pumped water is discharged in a generally rearward direction. A pivotally supported steering nozzle is normally mounted in registry with the discharge nozzle and is steered by means of a handlebar assembly 38 positioned forwardly of the seat 35 for steering of the watercraft 32, as is well known in this art.

Although the invention is adapted to be embodied in conjunction with any type of powering water vehicle, the invention is particularly adapted for use with jet propelled water vehicles and reference may be had to my U.S. Pat. No. 4,760,814, issued Aug. 2, 1988 and entitled, "Component Layout for Small Watercraft," which patent is assigned to the assignee hereof, for the construction of a type of watercraft which may be employed as the towing watercraft.

The construction of the towed watercraft 31 of this embodiment will now be described by particular reference to FIGS. 1–4. Like the towing watercraft 32, the towed watercraft has a hull made up of a lower hull portion 39 and an upper deck portion 41 which are formed from a suitable material such as a molded fiberglass reinforced resinous plastic material. In this embodiment, the lower hull portion 39 is constructed similarly to a catamaran and has a pair of transversely spaced apart lower hull parts 42 that are spaced by means of a generally planar undersection 43 which is normally disposed so as to be positioned above the level of water in which the watercraft is operating for a reason which will become readily apparent.

The hull and primarily the deck portion 41 forms a passenger compartment, indicated generally by the reference numeral 44 which is configured to accommodate a pair of passengers seated in side by side fashion as shown in phantom at 45 in the figures and thus is wider than the towing watercraft 32. The riders are adapted to be seated upon a seat formed by a pair of cushion portions 46 and back rests 47, which back rests are affixed to an upstanding storage compartment 48 formed at the rear of the hull to the rear of the passengers' compartment 44. A suitable access opening may be provided for placing articles into and removing them from the storage compartment 48 and this can be provided with a removable closure.

A pair of grab rails 49 extend from elevated portions of the compartment 48 forwardly and merge into the deck so as to provide a generally open side by side configuration while, at the same time, offering not only safety for the occupants or passengers 45, but also an arrangement wherein they may assist in boarding and leaving the towed watercraft 31. The configuration of the hull of the towed watercraft 31 and its buoyancy is such that the center of gravity G is positioned slightly forwardly of the occupant's center of gravity G' when seated upon the seats formed by the cushions 46 and back rests 47.

In this embodiment, a deck, indicated generally by the reference numeral 51 is provided at the rear of the storage compartment 48 and has a rear transom 52 which is configured so as to facilitate riders boarding the towed watercraft 31 from the rear from the body of water in which the watercrafts 31 and 32 are operating.

It should be noted that the passengers' seat afforded in the towed watercraft 31 is substantially lower than the rider's seat 35 of the towing watercraft 32. This means that the head of the operator 36 will be positioned substantially above the heads of the passengers 45 as clearly shown in FIG. 1 so that the operator's rear view is not in any way obstructed.

A towing arrangement, indicated generally by the reference numeral 53 is provided between the towed watercraft 31 and the towing watercraft 32. In this embodiment, the tow device 53 includes a pair of spaced apart tow bars 54 which are affixed at their forward ends to reinforcements 55 provided on the rear of the towing watercraft 32 and corresponding abutments or reinforcements formed on the hull of the towed watercraft 31 forwardly of the bows 56 of the respective hull portions 42. Each tow bar 54 has a construction and connection to the respective watercrafts of the type shown in FIGS. 5-8 and this construction will now be described by reference to those figures.

Each tow bar 54 is of a generally cylindrical shape and has a transverse tubular member 57 rigidly affixed to each end. The tubular member 57 receives an elastomeric bushing 58 which is also pressed around a connecting rod 59 that extends through the tubular member 57 and elastomeric bushing 58. This rod 59 affixes the assemblage to a mounting bracket 61 that is affixed in a suitable manner, as by means of fasteners 62 to the towing watercraft 32. The bracket 61 has a generally channel-shaped configuration and the rod 59 extends through upstanding ears 63 thereof and is held in place by threaded fasteners 64.

Figure 5:
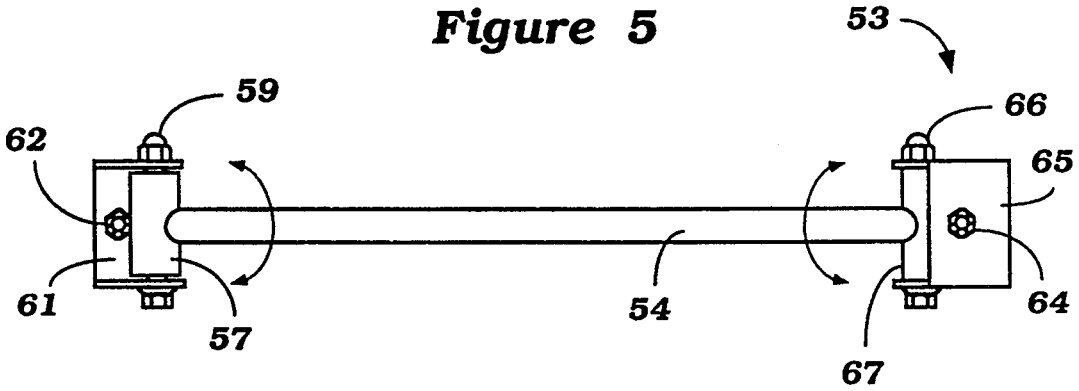
FIG. 5 is an enlarged top plan view of one of the traction or tow bars employed in conjunction with the invention.
Figure 6:
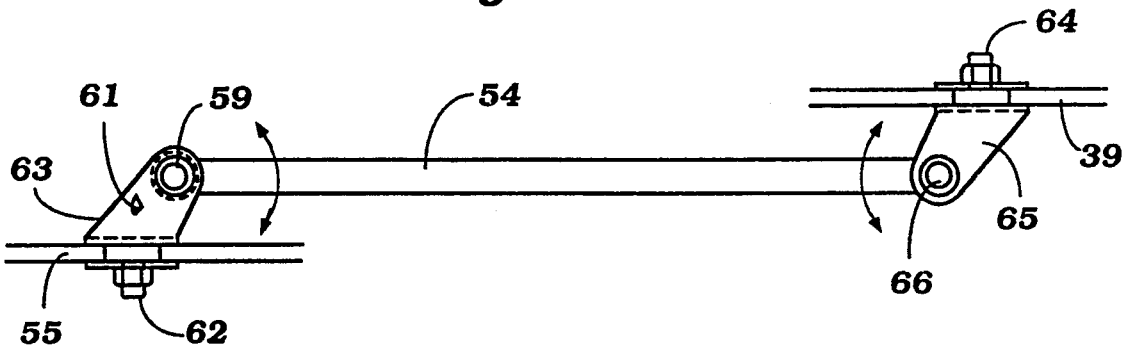
FIG. 6 is a side elevational view of the tow bar.
Figure 8:
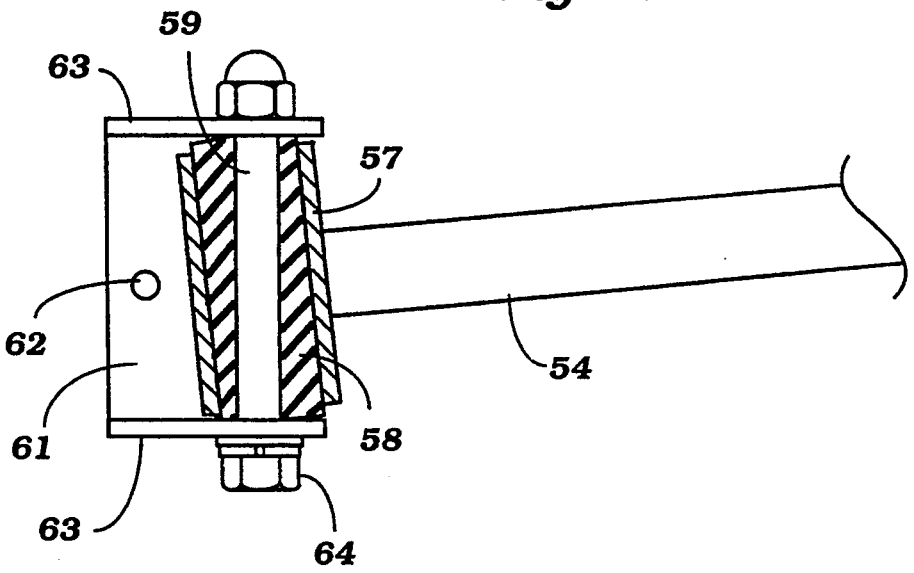
FIG. 8 is a cross-sectional view, in part similar to FIG. 7, and shows how the elastic joint can accommodate some pivotal movement.

The elastic bushing connection as thus far described permits pivotal movement of the tow rod 54 relative to a horizontal axis as shown in FIG. 6 and also about a transverse vertical axis as shown in FIGS. 5 and 8. As a result, there can be some movement in both directions so as to accommodate the slight movements of the towed watercraft 31 relative to the towing watercraft 32.

Figure 7:
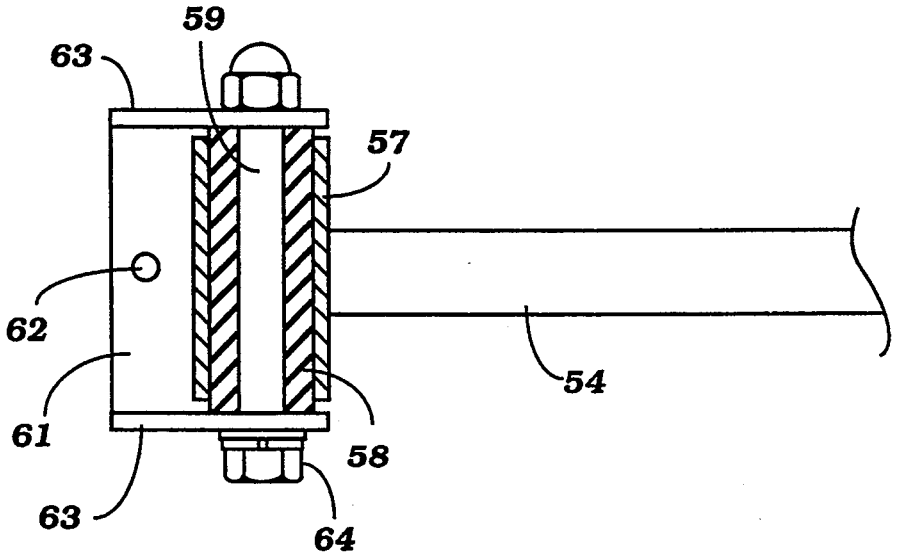
FIG. 7 is an enlarged cross-sectional view showing the elastic joint at one end of the tow bar.

Similar connections are provided at the rear end of the tow bars 54 to the towed watercraft 31 and because these connections are similar, the construction is not described but may be considered to be the same as that shown in FIGS. 7 and 8. This construction includes pairs of mounting brackets 65 that are affixed by fasteners 66 to the towed watercraft hull portion 39 and an elastomeric bushing (not shown) that encircles a fastening rod 66 which passes through the bracket 65 and through a tubular member 67 fixed to the trailing end of the tow rods 54. Pivotal movement about a horizontal and vertical axis is also provided by these elastomeric bushings as shown by the arrows in FIGS. 5 and 6.

Because there are provided a pair of two rods 54, one at each side between the towed watercraft 31 and the towing watercraft 32, the towed watercraft will generally follow the motion of the towing watercraft and will not swing to any significant amount in the event of sudden slowing of the towing watercraft 32. Also, the tow rods 54 will exert some slight downward force on the rear of the hull of the towing watercraft 32 so as to improve its stability. The amount of such force is controlled in part by the relative position of the towed watercraft's center of gravity G and that of the passengers G'. However, relative movement is provided by the elastomeric bushings as aforenoted.

As also should be readily apparent, the use of the catamaran type hull portions 42 and the raised and slightly curved forward end of the lower portion 43 will permit water discharged from the discharge nozzle of the towing watercraft 32 to flow beneath the towed watercraft 31 and thus no significant flow resistance or loss of driving efficiency will occur. FIGS. 1 and 3 show the center of the water discharge from the towing watercraft jet propulsion unit and indicate how this results is achieved. Of course when the steering nozzle is turned to its extreme position as shown in FIG. 3, there will be some slight interference, but only under this extreme condition.

Although in the figures the passengers 45 are shown in a seated position, the floor forwardly of the seat cushions 46 in the passengers' compartment 44 is generally flat so that the passengers 45 may either stand upon entry into the towed watercraft 31 or may stand during its operation.

Basically, the towed watercraft 31 has no propulsion device and its hull clearly affords no mechanism whereby a propulsion unit could be built into it. However, if desired, an outboard motor indicated at 81 may be mounted on the rear deck 51 (FIG. 9) for auxiliary propulsion of the towed watercraft 31. The storage compartment 48 may have sufficient size so as to accommodate the outboard motor 81 when it is not being employed to power the towed watercraft 31.

Figure 9:
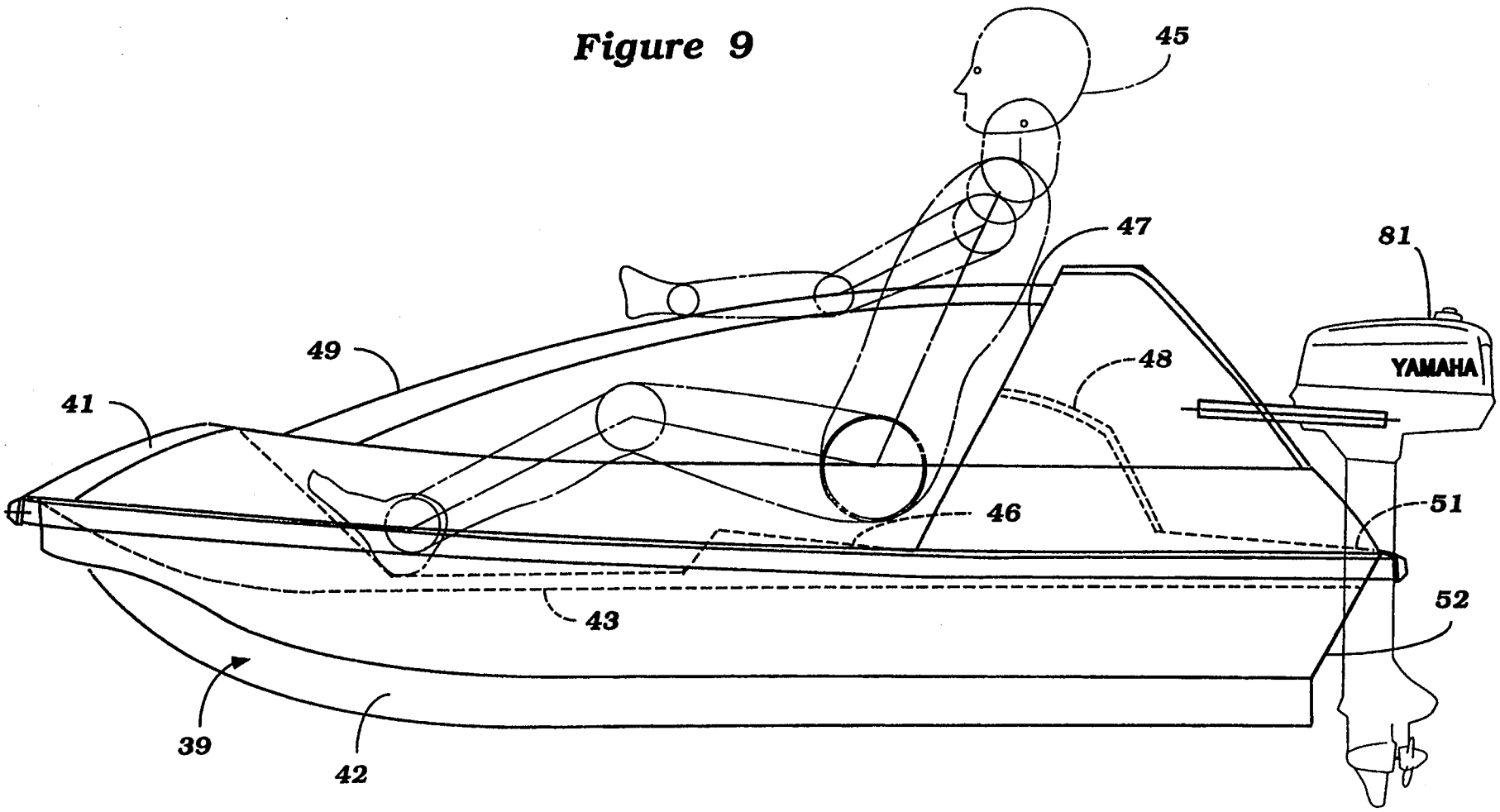
FIG. 9 is an enlarged side elevational view of the towed watercraft showing an embodiment wherein an auxiliary propulsion device may be employed.
Figures 10, 11, 12, 13:
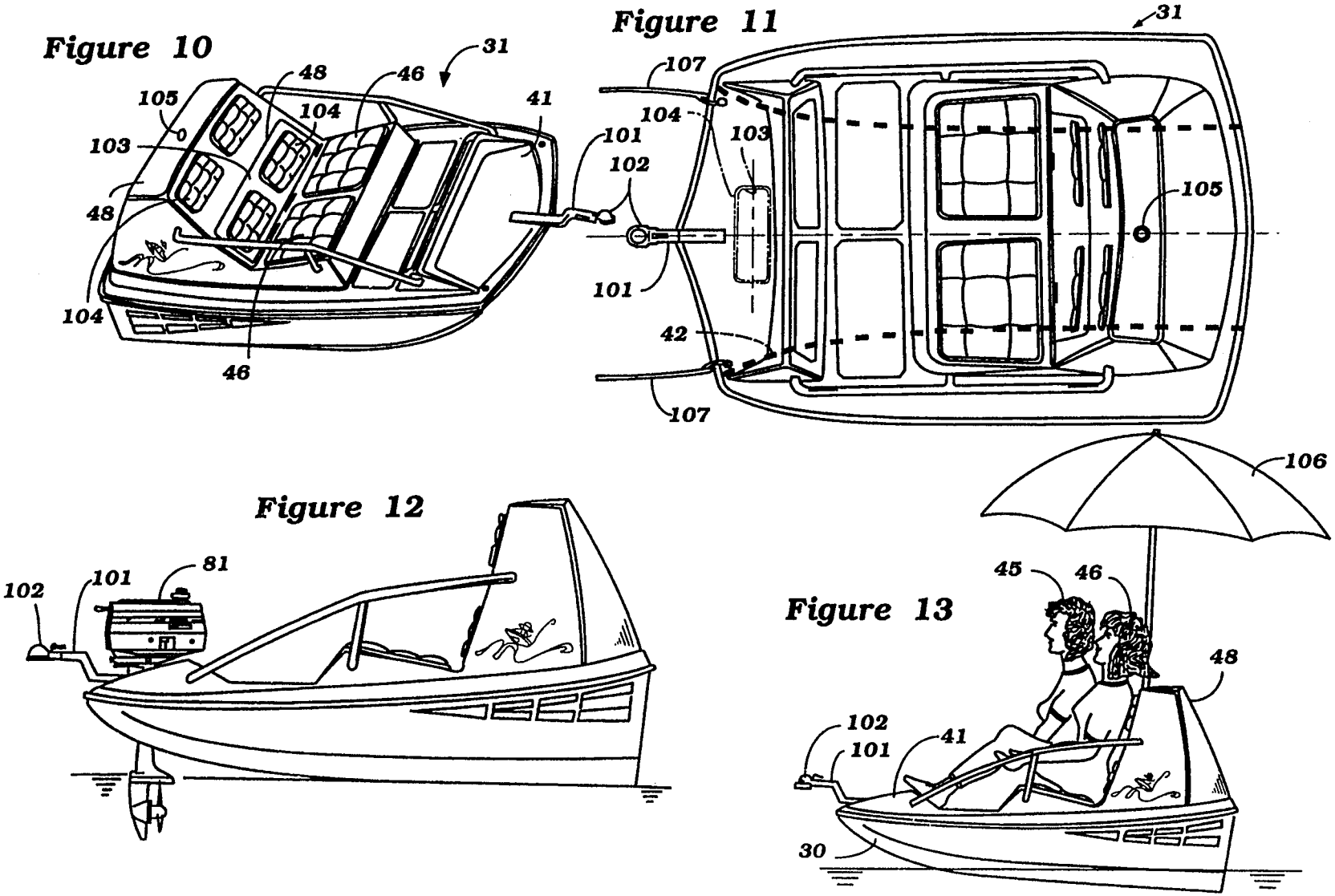
FIG. 10 is a top side perspective view of a towed watercraft constructed in accordance with another embodiment of the invention.
FIG. 11 is an enlarged top plan view of this embodiment of towed watercraft.
FIG. 12 is a side elevational view of this embodiment showing how an optional power source may be attached.
FIG. 13 is a side elevational view, on a somewhat smaller scale than FIG. 12, and shows how an optional passenger protection device may be installed.

FIGS. 10–13 show another embodiment of the invention which is generally similar to the embodiment of FIGS. 1–8 and of FIG. 9. Because of these basic similarities, the components of this watercraft which are the same as the previously described embodiment or substantially the same have been identified by the same reference numerals.

In this embodiment, a tow bar, indicated generally by the reference numeral 101, having a ball receiver 102 is rigidly connected to the front of the deck portion 41 and extends forwardly to provide a detachable connection to a ball (not shown) that will be affixed in a suitable manner to the towing watercraft. This ball hitch connection will permit side to side pivotal movement about a vertical axis and also pivotal movement about a horizontal axis so as to accommodate the wave motion between the towed and towing watercraft.

In this embodiment, the forward portion of the deck 41 is provided with an opening 103 that is normally covered by a removable hatch cover 104. The opening 103 is sized so as to accommodate the mounting of an outboard motor 81 through the opening for forward position propulsion of the towed watercraft 31. In this embodiment, the opening for the storage compartment 48 may be seen and it is closed by a pivoted panel 103 which carries a pair of lower seat back cushions 104. It should be noted that the storage compartment 48 in this embodiment is higher than in the previously described embodiments and there is no rear deck. The height is, however, well below the head of the operator of the towing vehicle so as to provide good rearward visibility. The upper end of the storage compartment 48 may be provided with a socket 105 that is adapted to receive an umbrella 106 or other form of shelter for the passengers 45. The umbrella 106 may be also stored within the storage compartment 48.

As has been noted, the tow bar 101 and ball receiver 102 will permit pivotal movement about a vertically extending pivot axis. This means that if the towing watercraft stops or slows abruptly, the towed watercraft may swing about the ball socket and strike the towing watercraft. To avoid this, a pair of ropes 107 may be interconnected between the sides of the towed watercraft 31 and the towing watercraft so as to limit the degree of pivotal movement to an amount that would prevent such contact. However, this connection is such so as to afford normal movement of the towing and towed watercrafts during steering motions.

Figure 14:
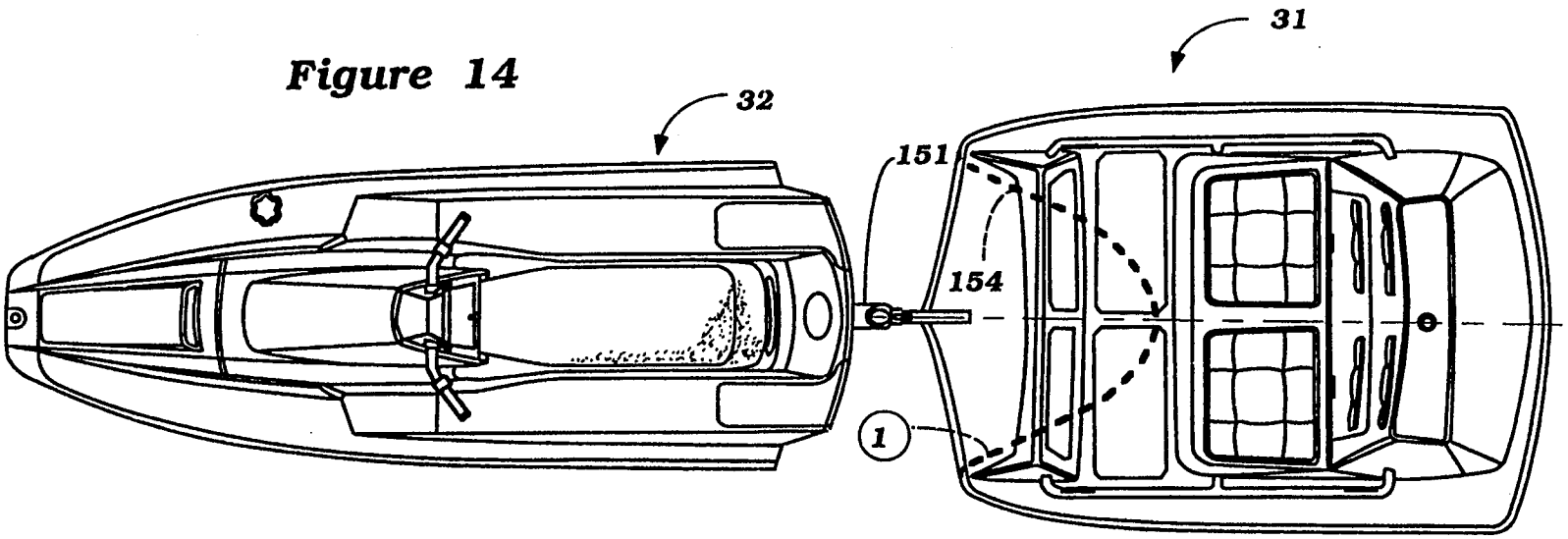
FIG. 14 is a top plan view of a towing and towed watercraft constructed in accordance with yet another embodiment of the invention.
Figure 15:
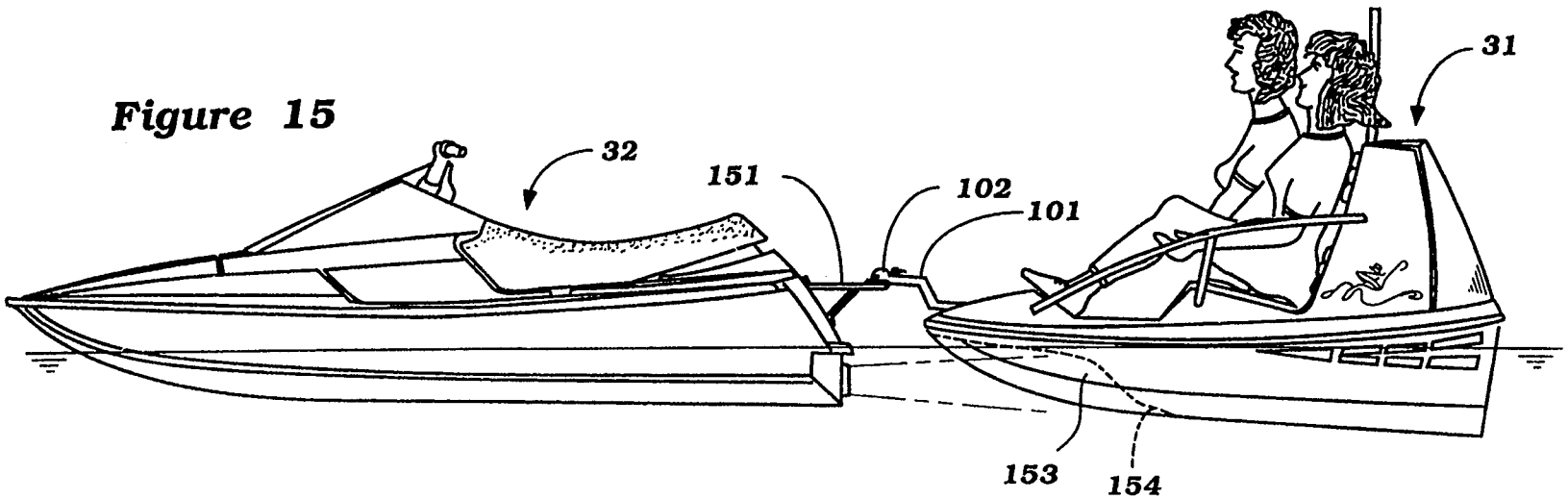
FIG. 15 is a side elevational view of this embodiment.
Figure 16:
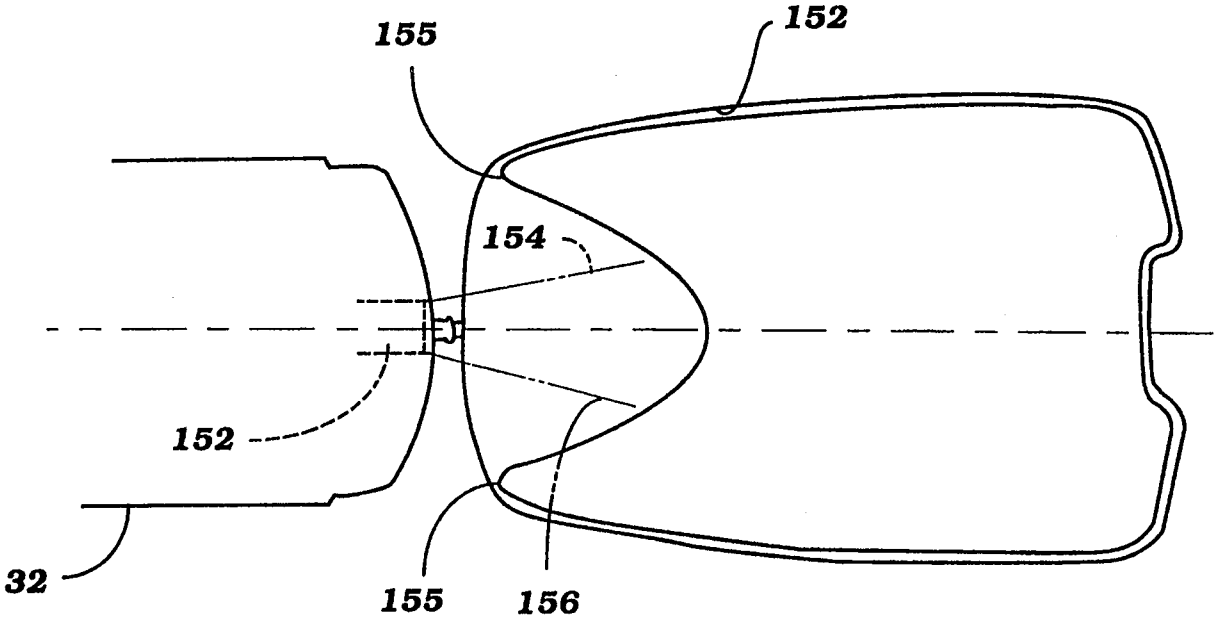
FIG. 16 is a partial bottom view of this embodiment.

In the embodiments of the invention as thus far described, the towed watercraft 31 has been provided with a catamaran type hull having spaced apart hull portions 42 that accommodate the unencumbered water flow from the discharge nozzle of the jet propulsion unit of the towing watercraft. FIGS. 14–16 show another embodiment of the invention which is generally the same in construction as the embodiment of FIGS. 10–13.

In this embodiment, the lower hull portion 39 has a different configuration and does not employ a full catamaran type hull. For that reason, only this portion of the hull construction will be described by particular reference to these figures. In this embodiment, however, the ball mount 151 for the ball at the rear of the towing vehicle 32 and the towing vehicle 32 are depicted. In addition, FIG. 16 shows the discharge nozzle 152 of the jet propulsion unit of the towing watercraft 32 so as to show how this embodiment operates to preclude any resistance to water flow.

In this embodiment, the towed watercraft 31 has a lower hull portion, indicated generally by the reference numeral 153 which is generally configured as a conventional hull, except for the fact that its forward end is provided with a recessed area 154 which tapers back from a pair of forward bow portions 155 and which also curves downwardly as shown in FIG. 15 so as to provide an area where the jet spray, indicated by the reference numeral 156 in FIG. 16, may pass from the powering jet propulsion unit of the towing watercraft 32 even when the steering nozzle redirects this spray 156. Hence, the recessed area 154 provides smooth flow of the water from the powering jet propulsion unit of the towing watercraft 32 without any significant resistance to the water flow or counter force on the towed watercraft 31. The recess 154 also offers a less blunt frontal area for the hull 153 of the towed watercraft 31 so as to further reduce its own water resistance.

It should be readily apparent from the foregoing descriptions that the preferred embodiments of the invention provide very effective towed watercrafts that can be towed by a small personal watercraft having a jet propulsion unit without interfering with the discharge of the jet discharge nozzle of the towing watercraft. In addition, various traction or towing arrangements have been depicted and arrangements have been shown how the small watercraft may carry its own propulsion unit such as an outboard motor that can be stored in its storage compartment. Of course, the foregoing description is that of preferred embodiments of the invention and various changes and modifications may be made without departing from the spirit and scope of the invention, as defined by the appended claims

We claim:

1. A towed watercraft adapted to be towed by a jet propelled watercraft having a discharge nozzle positioned towards its stern and discharging water generally rearwardly for propulsion thereof, said towed watercraft being comprised of a hull portion adapted to be submerged in part in a body of water and a rider's area carried at the upper end of said hull for carrying at least one rider, said rider's area being comprised of a floor area with a seat comprised of at least a seat cushion portion at the rear thereof and spaced above said floor area so that a rider seated on said seat cushion can have his legs extended forwardly into said floor area, the forward part of said hull portion defining a generally open area through which water discharge from the discharge nozzle of a towing jet propelled watercraft may pass without restriction.

2. A towed watercraft as set forth in claim 1 wherein the forward part of the hull portion is defined by a pair of spaced apart bow sections with a recessed area therebetween through which the water from the jet propulsion unit may pass.

3. A towed watercraft adapted to be towed by a jet propelled watercraft having a discharge nozzle positioned toward its stern and discharging water generally rearwardly for propulsion thereof, said towed watercraft being comprised of a hull portion submerged in part in a body of water and a rider's area carried at the upper end of said hull for carrying at least one rider, the forward part of said hull portion defining a generally open area through which water discharge from the discharge nozzle of a towing jet propelled watercraft may pass without restriction comprised of a pair of spaced apart bow sections with a recessed area therebetween through which the water from the jet propulsion unit may pass, said recess terminating short of the rider's area of the towed watercraft.

4. A towed watercraft as set forth in claim 2 wherein the hull of the towed watercraft has a catamaran hull having pairs of hull portions disposed on opposite sides.

5. A towed watercraft adapted to be towed by a jet having a discharge nozzle positioned toward its stern and discharging water generally rearwardly for propulsion thereof, said towed watercraft being comprised of a hull portion adapted to be submerged in part in a body of water and a rider's area carried at the upper end of said hull for carrying at least one rider, the forward part of said hull portion defining a generally open area through which water discharge from the discharge nozzle of a towing jet propelled watercraft may pass without restriction, said rider's area being provided with a seat for accommodating at least one rider and said rider's area seat being disposed lower than a seat on the towing watercraft so that an operator on the towing watercraft can see rearwardly even when a passenger is seated in the towed watercraft.

6. A towed watercraft as set forth in claim 5 wherein the seat of the towed watercraft is adapted to accommodate a pair of riders seated in side by side fashion.

7. A towed watercraft as set forth in claim 6 wherein the forward part of the hull portion is defined by a pair of spaced apart bow sections with a recessed area therebetween through which the water from the jet propulsion unit may pass, the seat being positioned substantially between the bow sections of the hull.

8. A towed watercraft as set forth in claim 7 wherein the recess terminates short of the rider's area of the towed watercraft.

9. A towed watercraft as set forth in claim 7 wherein the hull of the towed watercraft has a catamaran hull having pairs of hull portions disposed on opposite sides.

10. A towed watercraft as set forth in claim 5 wherein the towed watercraft is provided with an elevated container area to the rear of the rider's area and which forms a seat back for the rider.

11. A towed watercraft as set forth in claim 10 wherein the center of gravity of the towed watercraft is disposed forwardly of the center of gravity of a rider seated on the seat.

12. A towed watercraft as set forth in claim 11 further including means for accommodating an outboard motor on the hull of the towed watercraft for propulsion of the towed watercraft and wherein the container area is sized so as to accommodate the outboard motor when not in use.

13. A towed watercraft as set forth in claim 12 wherein the outboard motor is mounted to the rear of the passenger's area when powering the towed watercraft.

14. A towed watercraft as set forth in claim 12 wherein the outboard motor is mounted forwardly of the rider's area when powering the towed watercraft.

15. A towed watercraft as set forth in claim 1 further including traction means for towing of the towed watercraft from a towing watercraft.

16. A towed watercraft as set forth in claim 15 wherein the traction means comprises a rigid bar.

17. A towed watercraft as set forth in claim 16 wherein the rigid bar has a pivotal connection to at least one of the watercraft for allowing pivotal movement about a generally horizontally extending transverse pivot axis and about a vertically extending pivot axis.

18. A towed watercraft adapted to be towed by a jet propelled watercraft having a discharge nozzle positioned toward its stern and discharging water generally rearwardly for propulsion thereof, said towed watercraft being comprised of a hull portion adapted to be submerged in part in a body of water and a rider's area carried at the upper end of said hull for carrying at least one rider, the forward part of said hull portion defining a generally open area through which water discharge from the discharge nozzle of a towing jet propelled watercraft may pass without restriction, traction means for towing of said towed watercraft from the towing watercraft comprising a rigid bar, having a pivotal connection to at least one of the watercraft for allowing pivotal movement about a generally horizontally extending transverse pivot axis and about a vertically extending pivot axis, said pivotal connection comprising a bushing at one end of said bar receiving an elastomeric sleeve with a rod extending through said elastomeric sleeve and connected to one of the watercraft, said rod defining the transverse horizontally extending pivot axis and the deformation of the resilient sleeve defining the vertical pivot axis.

19. A towed watercraft as set forth in claim 18 wherein the towed watercraft is provided with an elevated container area to the rear of the rider's area and which forms a seat back for the rider.

20. A towed watercraft as set forth in claim 19 wherein the center of gravity of the towed watercraft is disposed forwardly of the center of gravity of a rider seated on the seat.

21. A towed watercraft as set forth in claim 18 wherein there is a pivotal connection as described in claim 18 between the rigid bar and each of the watercrafts.

22. A towed watercraft as set forth in claim 21 wherein the towed watercraft is provided with an elevated container area to the rear of the rider's area and which forms a seat back for the rider.

23. A towed watercraft as set forth in claim 22 wherein the center of gravity of the towed watercraft is disposed forwardly of the center of gravity of a rider seated on the seat.

24. A towed watercraft as set forth in claim 17 wherein there are a pair of rigid bars transversely spaced apart and interconnecting the towed watercraft with the towing watercraft.

25. A towed watercraft adapted to be towed by a jet propelled watercraft having a discharge nozzle positioned toward its stern and discharging water generally rearwardly for propulsion thereof, said towed watercraft being comprised of a hull portion adapted to be submerged in part in a body of water and a rider's area carried at the upper end of said hull for carrying at least one rider, the forward part of said hull portion defining a generally open area through which water discharge from the discharge nozzle of a towing jet propelled watercraft may pass without restriction, traction means for towing of said towed watercraft from a towing watercraft comprising a rigid bar, having a pivotal connection to at least one of the watercraft for allowing pivotal movement about a generally horizontally extending transverse pivot axis and about a vertically extending pivot axis, said there being a pair of rigid bars transversely spaced apart and interconnecting the towed watercraft with the towing watercraft, each pivotal connection comprises a bushing at one end of the bar receiving an elastomeric sleeve with a rod extending through the elastomeric sleeve and connected to one of the watercraft, the rod defining the transverse horizontally extending pivot axis and the deformation of the resilient sleeve defining the vertical pivot axis.

26. A towed watercraft as set forth in claim 25 wherein there is a pivotal connection between the rigid bar and each of the watercrafts, the pivotal connection comprising a bushing at one end of the bar receiving an elastomeric sleeve with a rod extending through the elastomeric sleeve and connected to one of the watercraft, the rod defining the transverse horizontally extending pivot axis and the deformation of the resilient sleeve defining the vertical pivot axis.

27. A towed watercraft as set forth in claim 26 wherein the towed watercraft is provided with an elevated container area to the rear of the rider's area and which forms a seat back for the rider.

28. A towed watercraft as set forth in claim 27 wherein the center of gravity of the towed watercraft is disposed forwardly of the center of gravity of a rider seated on the seat.

29. A towed watercraft as set forth in claim 17 wherein the traction means comprises a tow bar.

30. A towed watercraft adapted to be towed by a jet propelled watercraft having a discharge nozzle positioned toward its stern and discharging water generally rearwardly for propulsion thereof, said towed watercraft being comprised of a hull portion adapted to be submerged in part in a body of water and a rider's area carried at the upper end of said hull for carrying at least one rider, the forward part of said hull portion defining a generally open area through which water discharge from the discharge nozzle of a towing jet propelled watercraft may pass without restriction, and traction means for towing said towed watercraft from a towing watercraft comprising a rigid tow bar fixed relative to the towed watercraft at one end and having a ball receiver at its other end.

31. A towed watercraft as set forth in claim 30 further including a pair of ropes adapted to be affixed to opposite sides of the towed watercraft and to the towing watercraft for limiting pivotal movement about the vertical axis of the ball.

32. A towed watercraft as set forth in claim 31 wherein the towed watercraft is provided with an elevated container area to the rear of the rider's area and which forms a seat back for the rider.

33. A towed watercraft as set forth in claim 32 wherein the center of gravity of the towed watercraft is disposed forwardly of the center of gravity of a rider seated on the seat.

34. A towed watercraft as set forth in claim 30 wherein the tow bar has a pivotal connection to the towed watercraft with the pivotal connection defining a vertically extending axis.

35. A towed watercraft as set forth in claim 34 wherein the towed watercraft is provided with an elevated container area to the rear of the rider's area and which forms a seat back for the rider.

36. A towed watercraft as set forth in claim 35 wherein the center of gravity of the towed watercraft is disposed forwardly of the center of gravity of a rider seated on the seat.

37. A combination of a towing and a towed watercraft including a towing watercraft comprised of a hull, a propulsion device carried by said hull for propelling said towing watercraft and a rider's area accommodating at least an operator for said towed watercraft, a towed watercraft comprised of a hull defining a passenger's area having a floor area and a seat cushion extending above said floor area and adapted to accommodate at least a passenger in seated fashion, and means for attaching said towed watercraft to said towing watercraft to be towed thereby, said rider's area of said towing watercraft being positioned so that an operator's head will be positioned above the head of a passenger seated in the towed watercraft.

38. A combination of a towing and a towed watercraft as set forth in claim 37 wherein the seat of the towed watercraft is adapted to accommodate a pair of riders seated in side by side fashion.

39. A combination of a towing and a towed watercraft as set forth in claim 38 wherein the towed watercraft is provided with an elevated container area to the rear of the rider's area and which forms a seat back for the riders.

40. A combination of a towing and a towed watercraft as set forth in claim 39 wherein the center of gravity of the towed watercraft is disposed forwardly of the center of gravity of a rider seated on the seat.

41. A combination of a towing and a towed watercraft as set forth in claim 40 wherein the means for attaching the watercraft comprises traction means for towing of the towed watercraft from a towing watercraft.

42. A combination of a towing and a towed watercraft as set forth in claim 41 wherein the traction means comprises a rigid bar.

43. A combination of a towing and a towed watercraft as set forth in claim 42 wherein the rigid bar has a pivotal connection to at least one of the watercraft for allowing pivotal movement about a generally horizontally extending transverse pivot axis and about a vertically extending pivot axis.

44. A combination of a towing and a towed watercraft as set forth in claim 43 wherein the pivotal connection comprises a bushing at one end of the bar receiving an elastomeric sleeve with a rod extending through the elastomeric sleeve and connected to one of the watercraft, the rod defining the transverse horizontally extending pivot axis and the deformation of the resilient sleeve defining the vertical pivot axis.

45. A combination of a towing and a towed watercraft as set forth in claim 44 wherein there is a pivotal connection as described in claim 44 between the rigid bar and each of the watercrafts.

46. A combination of a towing and a towed watercraft as set forth in claim 43 wherein there are a pair of rigid bars transversely spaced apart and interconnecting the towed watercraft with the towing watercraft.

47. A combination of a towing and a towed watercraft as set forth in claim 46 wherein the pivotal connection comprises a bushing at one end of the bar receiving an elastomeric sleeve with a rod extending through the elastomeric sleeve and connected to one of the watercraft, the rod defining the transverse horizontally extending pivot axis and the deformation of the resilient sleeve defining the vertical pivot axis.

48. A combination of a towing and a towed watercraft as set forth in claim 47 wherein there is a pivotal connection as described in claim 47 between the rigid bar and each of the watercrafts.

49. A combination of a towing and a towed watercraft as set forth claim 43 wherein the traction means comprises a tow bar.

50. A combination of a towing and a towed watercraft as set forth in claim 49 wherein the tow bar is fixed relative to the towed watercraft at one end and has a ball receiver at its other end.

51. A combination of a towing and a towed watercraft as set forth in claim 50 further including a pair of ropes adapted to be affixed to opposite sides of the towed watercraft and to the towing watercraft for limiting pivotal movement about the vertical axis of the ball.

52. A combination of a towing and a towed watercraft as set forth in claim 50 wherein the tow bar has a pivotal connection to the towed watercraft with the pivotal connection defining a vertically extending axis.

53. A combination of a towing and a towed watercraft including a towing watercraft comprised of a hull, a propulsion device carried by said hull for propelling said towing watercraft and a rider's area accommodating at least one operator for said towing watercraft, a towed watercraft comprised of a hull defining a passenger's area having a floor area and a seat cushion extending above said floor area and adapted to accommodate at least a passenger in seated fashion, and means for attaching said towed watercraft to said towing watercraft to be towed thereby, said rider's area of said towing watercraft being positioned so that an operator's head will be positioned above the head of a passenger seated in the towed watercraft.

54. A combination of a towing and a towed watercraft as set forth in claim 53 wherein the rigid bar has a pivotal connection to at least one of the watercraft for allowing pivotal movement about a generally horizontally extending transverse pivot axis and about a vertically extending pivot axis.

55. A combination of a towing and a towed watercraft as set forth in claim 54 wherein the pivotal connection comprises a bushing at one end of the bar receiving an elastomeric sleeve with a rod extending through the elastomeric sleeve and connected to one of the watercraft, the rod defining the transverse horizontally extending pivot axis and the deformation of the resilient sleeve defining the vertical pivot axis.

56. A combination of a towing and a towed watercraft as set forth in claim 55 wherein the towed watercraft is provided with an elevated container area to the rear of the rider's area and which forms a seat back for the rider.

57. A combination of a towing and a towed watercraft as set forth in claim 56 wherein the center of gravity of the towed watercraft is disposed forwardly of the center of gravity of a rider seated on the seat.

58. A combination of a towing and a towed watercraft as set forth in claim 55 wherein there is a pivotal connection as described in claim 55 between the rigid bar and each of the watercrafts.

59. A combination of a towing and a towed watercraft as set forth in claim 58 wherein the towed watercraft is provided with an elevated container area to the rear of the rider's area and which forms a seat back for the rider.

60. A combination of a towing and a towed watercraft as set forth in claim 59 wherein the center of gravity of the towed watercraft is disposed forwardly of the center of gravity of a rider seated on the seat.

61. A combination of a towing and a towed watercraft as set forth in claim 54 wherein there are a pair of rigid bars transversely spaced apart and interconnecting the towed watercraft with the towing watercraft.

62. A combination of a towing and a towed watercraft as set forth in claim 61 wherein the pivotal connection comprises a bushing at one end of the bar receiving an elastomeric sleeve with a rod extending through the elastomeric sleeve and connected to one of the watercraft, the rod defining the transverse horizontally extending pivot axis and the deformation of the resilient sleeve defining the vertical pivot axis.

63. A combination of a towing and a towed watercraft as set forth in claim 62 wherein there is a pivotal connection as described in claim 62 between the rigid bar and each of the watercrafts.

64. A combination of a towing and a towed watercraft as set forth in claim 63 wherein the towed watercraft is provided with an elevated container area to the rear of the rider's area and which forms a seat back for the rider.

65. A combination of a towing and a towed watercraft as set forth in claim 64 wherein the center of gravity of the towed watercraft is disposed forwardly of the center of gravity of a rider seated on the seat.

66. A combination of a towing and a towed watercraft as set forth in claim 54 wherein the tow bar is fixed relative to the towed watercraft at one end and has a ball receiver at its other end.

67. A combination of a towing and a towed watercraft as set forth in claim 66 further including a pair of ropes adapted to be affixed to opposite sides of the towed watercraft and to the towing watercraft for limiting pivotal movement about the vertical axis of the ball.

68. A combination of a towing and a towed watercraft as set forth in claim 67 wherein the towed watercraft is provided with an elevated container area to the rear of the rider's area and which forms a seat back for the rider.

69. A combination of a towing and a towed watercraft as set forth in claim 68 wherein the center of gravity of the towed watercraft is disposed forwardly of the center of gravity of a rider seated on the seat.

70. A combination of a towing and a towed watercraft as set forth in claim 66 wherein the tow bar has a pivotal connection to the towed watercraft with the pivotal connection defining a vertically extending axis.

71. A combination of a towing and a towed watercraft as set forth in claim 70 wherein the towed watercraft is provided with an elevated container area to the rear of the rider's area and which forms a seat back for the rider.

72. A combination of a towing and a towed watercraft as set forth in claim 71 wherein the center of gravity of the towed watercraft is disposed forwardly of the center of gravity of a rider seated on the seat.

73. A towed watercraft for primary water operation by towing by a towing watercraft, said towed watercraft being comprised of a hull defining a rider's area for accommodating at least one passenger, said hull being devoid of a propulsion device but formed with means for accommodating an outboard motor for propulsion thereon, an elevated container area to the rear of the rider's area and which forms a set back for the rider.

74. A towed watercraft as set forth in claim 73 wherein the container area is sized so as to accommodate the outboard motor when not in use.

75. A towed watercraft as set forth in claim 74 where the means for mounting the outboard motor for propulsion is to the rear of the passenger's area when the outboard motor is powering the towed watercraft.

76. A towed watercraft as set forth in claim 74 where the means for mounting the outboard motor is forwardly of the rider's area when outboard motor is powering the towed watercraft.

77. A towed watercraft as set forth in claim 76 wherein the front mounting of the outboard motor is provided by an access opening formed in the forward portion of the hull of the towed watercraft.

* * * * *